United States Patent [19]

DeBruyn

[11] Patent Number: 4,616,940

[45] Date of Patent: Oct. 14, 1986

[54] VERTICALLY ADJUSTABLE ROTATABLE SHELF ASSEMBLY

[75] Inventor: William DeBruyn, Rockford, Ill.

[73] Assignee: Amerock Corporation, Rockford, Ill.

[21] Appl. No.: 713,278

[22] Filed: Mar. 18, 1985

[51] Int. Cl.[4] ..... F16C 23/02; A47B 81/00; A47F 3/10

[52] U.S. Cl. ..... 384/248; 312/305; 384/243; 403/104

[58] Field of Search ..... 312/305, 125, 312, 135, 312/238, 197; 108/144; 248/413, 354.3; 403/104, 109, 377; 384/226, 227, 242, 247, 248, 249, 240, 243, 245, 244, 420

[56] References Cited

U.S. PATENT DOCUMENTS

| | | | |
|---|---|---|---|
| 2,536,503 | 1/1951 | Jones | 248/413 X |
| 3,266,857 | 8/1966 | Anderson | 312/252 |
| 3,281,197 | 10/1966 | Anderson | 312/305 |
| 4,181,037 | 1/1980 | Boon et al. | 74/569 |
| 4,433,885 | 2/1984 | Baker | 312/305 |
| 4,486,106 | 12/1984 | Benting | 384/248 |

OTHER PUBLICATIONS

Installation Instructions for Lescoa HB0250 Lazy Susan Set, publication date unknown.

Pp. 1, 5, 9, 11, 13, 15, 17, 18, 19 and 20 of a catalog published by Scovill, Inc. in 1980 and entitled *Nu-Tone Ajax Rev-A-Shelf Cabinet Storage Organizers.*

*Primary Examiner*—Stuart S. Levy
*Assistant Examiner*—David Werner
*Attorney, Agent, or Firm*—Leydig, Voit & Mayer, Ltd.

[57] ABSTRACT

A vertical post is rotatably mounted in a corner cabinet and supports a plurality of rotatable shelves which carry the cabinet door. The lower end of the post is rotatably supported by a lower bearing element which rests on a bearing member on the bottom wall of the cabinet. To enable the post and the door to be adjusted vertically, the lower bearing element is a slide supported for up and down movement in the post and having a downwardly inclined ramp on its upper end. A downwardly inclined screw extends perpendicular to the ramp and may be tightened and loosened to shift the slide downwardly and upwardly relative to the post. The head of the screw is sunk within the post to enable the shelves to be slipped onto the lower end of the post during assembly and to enable one of the shelves to pass upwardly by the location of the screw.

10 Claims, 11 Drawing Figures

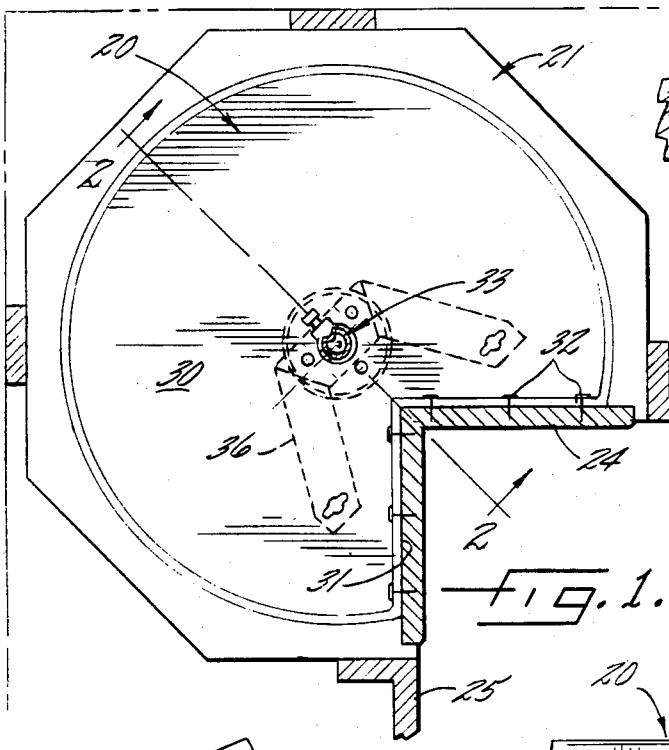
Fig. 1.
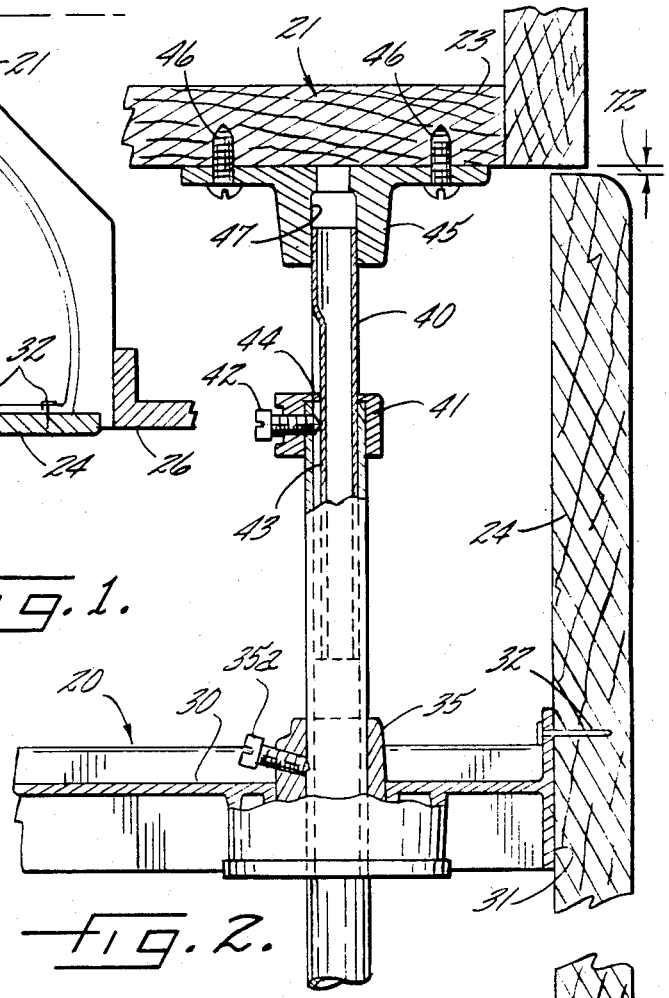
Fig. 2.
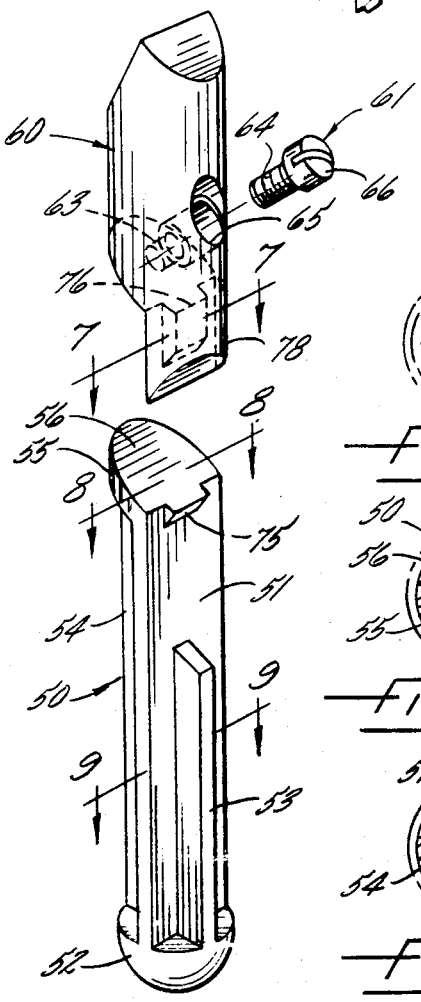
Fig. 6.
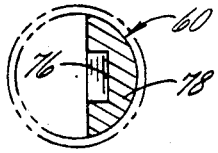
Fig. 7.
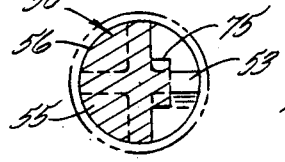
Fig. 8.
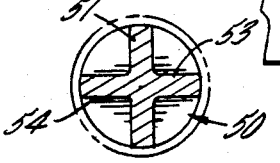
Fig. 9.
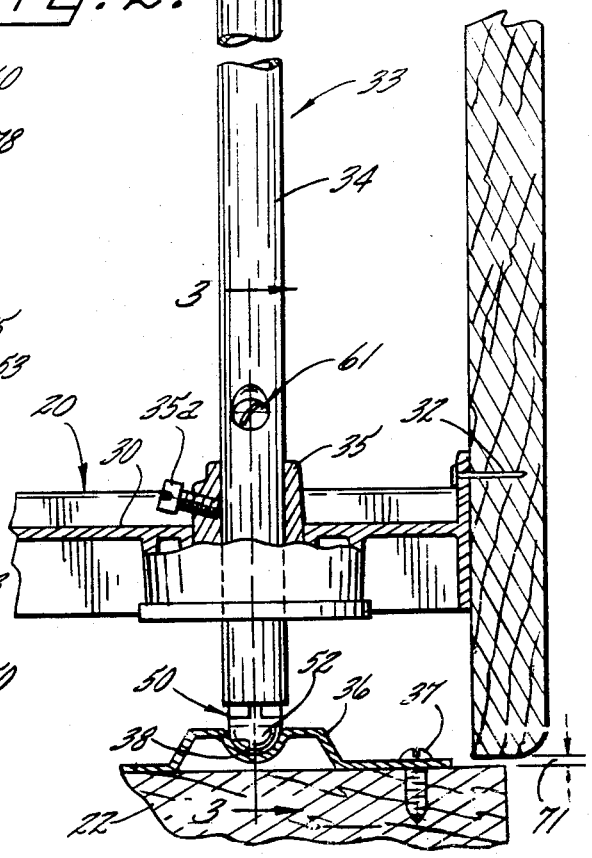

VERTICALLY ADJUSTABLE ROTATABLE SHELF ASSEMBLY

BACKGROUND OF THE INVENTION

This invention relates to a rotary shelf assembly which includes a rotatable vertical post supporting a plurality of shelves. More particularly, the invention relates to such an assembly which is adapted to be mounted in the corner of a cabinet frame and, to this end, each shelf is circular except for a section having edges which are perpendicular to each other and which, in one angular position of the post, are alined with the sides of the cabinet frame at the corner of the latter. A V-shaped door is secured to these edges so that the door turns with the post and the shelves to present the shelves to an opening in the frame. To support the post for turning, upper and lower bearing elements carried at the ends of the post cooperate with upper and lower bearing members which are vertically alined and are secured to the cabinet frame.

Such assemblies usually are assembled at a factory or a shop and installed in the cabinet in that condition. Accordingly, the assemblies include means to adjust the vertical spacing of the bearing elements to accommodate the vertical spacing of the bearing members in each individual cabinet and to enable the upper and lower edges of the door to be properly adjusted vertically relative to the cabinet frame.

One such adjusting means is disclosed in Benting U.S. Pat. No. 4,486,106. In the Benting arrangement, the lower bearing element is mounted on a slide which is disposed in the lower end portion of the post for endwise movement. The slide is moved down relative to the post by a cam which is disposed within the post and coacts with a cam follower on the slide, the cam being moved along the follower by a manual actuator mounted on and extending radially through the post.

SUMMARY OF THE INVENTION

The general aim of the present invention is to provide a rotatable post assembly of the above general type having new and improved adjusting means which enable the shelves to be slipped onto the post from the lower end thereof, which involve fewer parts, which may be assembled more quickly and easily with the post and which may be assembled to the post in a more permanent manner better insuring against accidental disassembly prior to the time the post is installed in the cabinet.

Another object is to achieve the foregoing by arranging the manual actuator and the slide in a unique manner allowing the manual actuator to be sunk within the outer wall of the post and allowing the manual actuator to effect direct shifting of the slide without need of an intervening cam.

The invention also resides in the novel construction of the slide and an anchor block enabling these members to be assembled endwise into the post and then held permanently therein by a simple swaging operation.

These and other objects and advantages of the invention will become more apparent from the following detailed description when taken in conjunction with the accompanying drawings.

BRIEF DESCRIPTION OF THE DRAWINGS

FIG. 1 is a fragmentary cross-sectional view taken horizontally through a typical cabinet equipped with a new and improved rotatable post assembly incorporating the unique features of the present invention.

FIG. 2 is an enlarged fragmentary cross-section taken substantially along the line 2—2 of FIG. 1.

FIG. 6 is an exploded perspective view of the slide, the anchor block and the actuator.

FIGS. 7, 8 and 9 are cross-sections taken substantially along the lines 7—7, 8—8 and 9—9, respectively, of FIG. 6.

DETAILED DESCRIPTION OF THE PREFERRED EMBODIMENT

Figure 3:
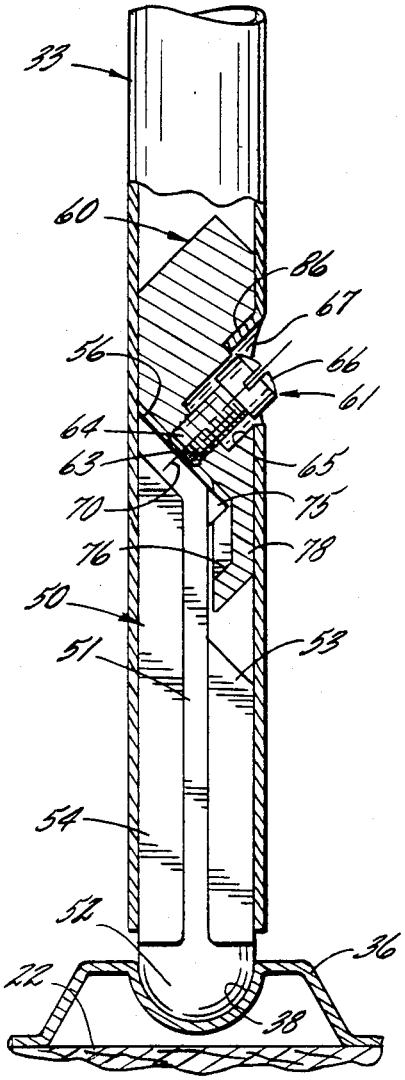
FIG. 3 is an enlarged fragmentary cross-section taken substantially along the line 3—3 of FIG. 2 and shows the post adjusted to a raised position.

For purposes of illustration, the shelf assembly 20 of the present invention is shown in the drawings in conjunction with a corner cabinet 21 which may be located in the corner of a room and preferably at the ends of cabinets extending along two right-angled walls of the room. The corner cabinet includes a bottom wall 22, a top wall 23 and a generally V-shaped door 24 with two right-angled panels. When the door is positioned as shown in FIG. 1, its panels close the front opening of the cabinet and coact with cabinet frame members 25 and 26 to form an aesthetically pleasing corner. The frame members 25 and 26 usually are part of the face frame of the corner cabinet 21 but may be parts of the frames of the adjacent cabinets.

Herein, the shelf assembly 20 includes two vertically spaced and generally circular shelves 30. The shelves are adapted to be rotated within the cabinet 21 and, in order to accommodate the door 24, each shelf is formed with a generally pie-shaped cutout 31 (FIG. 1) whose right-angled edges lie alongside the panels of the door. Fasteners 32 (FIG. 2) secure the door rigidly to the shelves and thus the door rotates with the shelves in order to expose the front opening of the cabinet and to present the shelves to the front opening.

The shelves 30 turn with a rotatable vertical post assembly 33 (FIG. 2) which enables the shelf assembly 20 to be installed easily in the cabinet 21. Herein, the post assembly includes a cylindrical lower post 34 in the form of a tube. As shown in FIG. 2, the post 34 extends upwardly a substantial distance within the cabinet 21 and supports both shelves 30. Collars 35 are attached to the shelves in the manner disclosed in Benting U.S. Pat. No. 4,486,106 and are attached to the post by set screws 35*a*. The lower end of the post 34 is rotatably supported by a bearing member 36 attached to the lower bottom wall 22 of the cabinet 21 by screws 37 and formed with an upwardly opening socket 38.

The post assembly 33 further includes an upper post 40 (FIG. 2) which is adapted to be telescoped into the upper end portion of the lower post 34 and adjusted vertically relative thereto to enable the post assembly to be installed in cabinets of different heights. An end cap 41 is attached to the upper end of the lower post 34 by a set screw 42 and holds the upper post in a fixed vertical position when the screw is tightened and seats in a V-shaped channel 43 formed by swaging one side of the upper post along substantially its entire length. The end cap is formed with a key 44 which fits into the channel 43 to prevent the upper post 40 from rotating relative to the lower post 34 while permitting vertical adjustment of the upper post when the screw 42 is loosened.

A bearing member 45 (FIG. 2) is attached to the upper wall 23 of the cabinet 21 by screws 46 and rotatably supports the upper end portion of the post 40. Herein, the bearing member 45 is formed with a cylindrical hole 47 which rotatably and slidably receives the upper end portion of the post 40 and permits vertical adjustment of the post.

While the vertical adjustment between the posts 34 and 40 enables the entire post assembly 33 to be lengthened or shortened to fit cabinets of different heights, an additional adjustment of the post 34 is necessary to enable the door 24 to be adjusted upwardly or downwardly to a precisely centered position between the bottom and top walls 22 and 23 of the cabinet 21. In accordance with the present invention, such adjustment is effected by unique means which require very few parts and which may be easily and permanently secured to the post 34. Moreover, the adjusting means of the invention enable the shelves 30 to be assembled to the post by slipping the shelves upwardly along the post from the lower end thereof.

Herein, the adjusting means comprise a slide 50 which is telescoped slidably and non-rotatably into the lower end of the post 34 and is adapted to be adjusted upwardly and downwardly within the post. The slide is made of plastic and includes a vertically extending and plate-like body 51 which is centered within the post. Molded integrally with the lower end of the body is a hemispherical bearing element 52 which seats rotatably in the socket 38 of the bearing member 36 to support the lower end of the post 34 for rotation.

Stiffening ribs 53 and 54 are molded integrally with opposite sides of the body 51 and extend upwardly along the body from the bearing element 52. The rib 53 extends to a level just somewhat above the lengthwise midpoint of the body while the rib 54 extends upwardly along the entire length of the body. The body and the ribs coact to form a cross-shaped structure (see FIG. 9) which fits into the post 34 and engages the inner wall thereof to locate the slide radially within the post.

In keeping with the invention, the upper end of the slide 50 is formed with a head 55 whose upper surface is inclined downwardly and defines a ramp 56 for use in adjusting the slide upwardly and downwardly. As shown in FIG. 6, the head is molded integrally with one side of the upper end of the body 51 and its lower side is integral with and is braced by the rib 54. The head is generally semicircular in shape and is inclined such that its upper surface or ramp 56 slopes downwardly at an angle of 45 degrees.

To effect up and down adjustment of the slide 50, a nut or anchor member 60 is fixed within the post 34 and supports a manual actuator or screw 61 which coacts with the ramp 56 of the slide 50 to adjust the latter. The anchor member 60 is in the form of a metal block having a generally circular cross-section and sized to substantially fill a length of the post 34 above the slide 50. A threaded hole 63 (FIG. 3) is formed through the anchor block 60 and receives the threaded shank 64 of the screw 61. A counterbore 65 is formed in the block 60 outwardly of the hole 63 and is sized to receive the head 66 of the screw 61. The screw is adapted to be inserted into the block 60 through a hole 67 formed through one side of the post.

Pursuant to the invention, the axis 70 (FIG. 3) of the threaded hole 63 extends perpendicular to the ramp 56 so as to locate the screw 61 at a right angle relative to the ramp. When the screw is tightened, its inner end engages and pushes downwardly against the ramp. Because the bearing element 52 of the slide 50 is stopped against moving downwardly by the bearing member 36, the reaction force created during tightening of the screw causes the post 34 to shift upwardly relative to the stopped slide from the position shown in FIG. 3 toward the position shown in FIG. 4. Thus, tightening of the screw effects upward adjustment of the post 34 and the door 24 to increase the height of the gap 71 (FIG. 2) between the lower edge of the door and the bottom wall 22 of the cabinet 21 and to decrease the height of the gap 72 between the upper edge of the door and the top wall 23 of the cabinet. As the screw is tightened and the post 34 moves upwardly, the inner end of the screw travels upwardly along the ramp from the position shown in FIG. 3 to the position shown in FIG. 4.

Loosening of the screw 61 effects lowering of the post 34 relative to the stopped slide 50. Thus, as the screw is loosened, the weight of the post causes the post to move downwardly and, as an incident thereto, the inner end of the screw travels downwardly along the ramp 56. The post and the door 24 thus may be lowered to reduce the height of the gap 72 and increase the height of the gap 71. By making fine adjustments to the screw, the post and the door may be adjusted to cause the gaps 71 and 72 to be of equal height and thereby effect a precise installation of the door in the cabinet.

Means are provided for preventing the slide 50 from rotating relative to the anchor block 60 and for captivating the slide against sliding relative to the anchor block beyond a limited range. In the present instance, these means comprise a generally triangular lug 75 (FIG. 6) located at the lower edge of the ramp 56 and formed integrally with and projecting from the adjacent side of the slide body 51, the upper surface of the lug forming a smooth continuation of the ramp. The lug is adapted to fit in a vertically elongated pocket 76 (FIGS. 3 and 7) formed in a tongue 78 projecting downwardly from the lower end of the anchor block 60. The inner side of the tongue is flat and planar and generally lies face-to-face with the upper end portion of the body 51 to restrict rotation of the slide 50 in the post 34. Upward and downward sliding of the slide 50 relative to the post 34 is limited when the lug 75 engages the upper and lower ends of the pocket 76 and thus the slide is limited to movement within a range equal to the height of the pocket.

Figure 10:
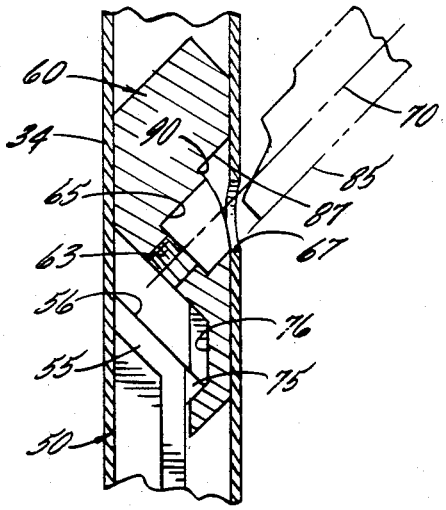
FIGS. 10 and 11 are cross-sectional views schematically showing successive steps of securing the slide and the anchor block in the post.

The slide 50 and the anchor block 60 are adapted to be assembled easily and permanently with the post 34. To effect such assembly, the slide and the anchor block are moved sidewise toward one another while outside of the post thereby to place the lug 75 into the pocket 76. Thereafter, the anchor block and the slide are inserted endwise into the lower end of the post and are moved upwardly until the axis 70 of the hole 63 is located slightly above the center of the hole 67. As shown in FIG. 10, the hole 67 initially is circular and is initially located with its axis extending perpendicular to the axis of the post 34.

Figure 11:
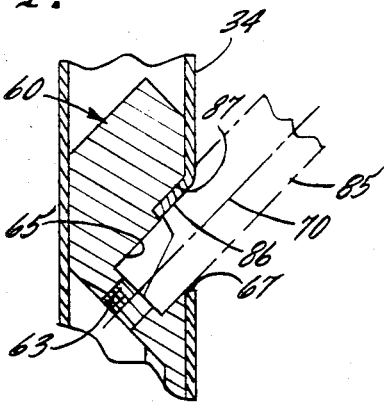

After the parts have been fixtured in the position shown in FIG. 10, a swaging punch 85 is moved downwardly along a line coinciding with the axis 70 of the hole 63. During such movement, the punch engages the metal around the upper portion of the hole 67 and swages such metal inwardly to form a flange 86 (FIG. 11) which is forced into face-to-face relation with the wall 87 of a partial counterbore formed at the outer end of the counterbore 65. Engagement of the flange 86 with the wall 87 prevents the block 60 from sliding downwardly in the post 34. In addition, the lower free edge of the flange 86 locks against a shoulder 90 (FIG. 10) at the inner end of the wall 87 to prevent upward sliding of the block within the post.

Figure 4:
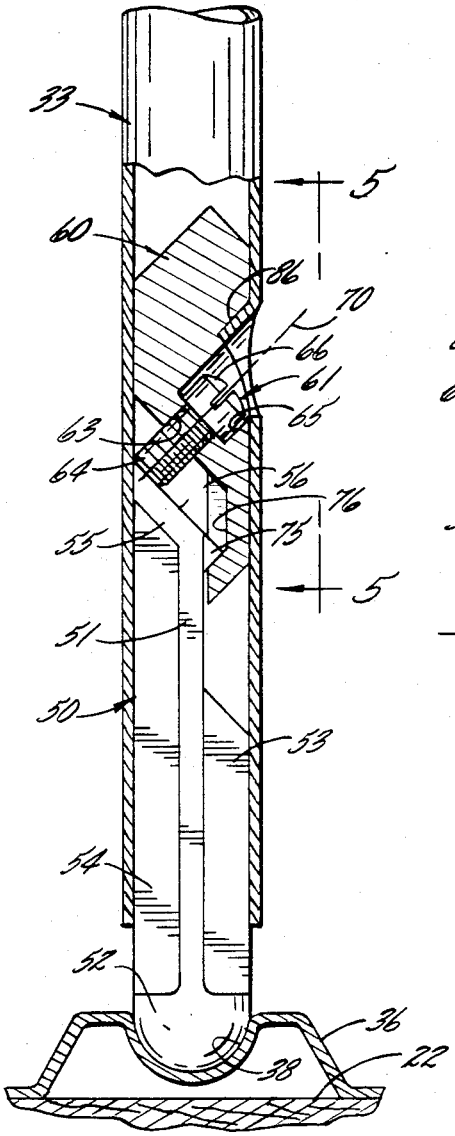
FIG. 4 is a view similar to FIG. 3 but shows the post adjusted to a lowered position.
Figure 5:
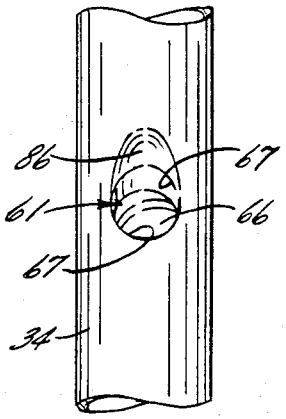
FIG. 5 is a side elevational view taken substantially along the line 5—5 of FIG. 4.

As shown in FIG. 4, the head 66 of the screw 61 is located completely within the counterbore 65 and does not protrude outwardly of the outer side of the post 34 when the screw is in a tightened condition. As a result of the screw being completely sunk within the post, the shelves may be assembled with the post by slipping the shelves onto the lower end of the post and moving the shelves upwardly. The upper shelf may be moved upwardly past the sunken screw to the position shown in FIG. 2. The lower shelf is located below the screw to allow easy access to the screw.

From the foregoing, it will be apparent that the post adjusting means requires only three parts, namely, the slide 50, the anchor block 60 and the screw 61. The anchor block permanently captivates the slide against rotation within the post 34 and prevents the slide from slipping out of the post prior to installation of the post assembly 33 in the cabinet 21. In turn, the easily formed flange 86 permanently holds the anchor block against rotation and prevents endwise sliding of the anchor block. Because the sunken screw 61 enables the shelves 30 to be assembled from the bottom of the post, such assembly may be effected without disassembling any parts of the post.

I claim:

1. A rotatable post assembly comprising upper and lower opposing bearing members, an elongated post extending vertically between said bearing members and having an upper end portion rotatably supported by said upper bearing member, the lower end portion of said post being tubular, a slide having upper and lower end portions and telescoped into the lower end portion of the post, a bearing element on the lower end portion of said slide and located below the lower end portion of said post to engage said lower bearing member and rotatably support the lower end portion of the post, a downwardly inclined surface formed on the upper end portion of said slide, a threaded hole, and a screw having a shank extending through one side of said post and threaded into said hole, the axis of said screw being inclined at an acute angle relative to the longitudinal axis of said post and being disposed substantially perpendicular to said inclined surface, the inner end of said screw slidably engaging said inclined surface whereby tightening of said screw forces said slide downwardly relative to said post while loosening of said screw permits said slide to move upwardly relative to said post.

2. A rotatable post assembly as defined in claim 1 in which the outer end of said screw is located inwardly of said one side of said post.

3. A rotatable post assembly as defined in claim 1 further including a nut anchored within said post and formed with said threaded hole.

4. A rotatable post assembly as defined in claim 3 including coacting means on said nut and said slide to restrict rotation of said slide within said post and to captivate said slide against sliding upwardly and downwardly beyond a limited range relative to said post.

5. A rotatable post assembly as defined in claim 4 further including means struck inwardly from said post and staking said nut against rotating and sliding within said post.

6. A rotatable post assembly comprising upper and lower opposing bearing members, a post extending vertically between said bearing members and having an upper end portion rotatably supported by said upper bearing member, the lower end portion of said post being cylindrical and tubular, a slide having upper and lower end portions telescoped in the lower end portion of said post, a bearing element on the lower end portion of said slide and located below the lower end portion of said post to engage said lower bearing member and rotatably support the lower end portion of said post, an anchor block engageable with said slide and having means for restricting rotation of said slide relative to said post about the axis of the post and for restricting up and down sliding of the slide relative to the post beyond a limited range, said anchor block and said slide being insertable as a unit into said post from one end thereof, means struck inwardly from said post and engaging said anchor block to prevent said anchor block from rotating and sliding within the post, a downwardly inclined surface formed on the upper portion of said slide, a threaded hole formed through said anchor block and having an axis disposed substantially perpendicular to said inclined surface, and a screw having a shank extending through one side of said post and threaded into the hole in said anchor block, the inner end of said screw engaging said inclined surface whereby tightening of said screw forces said slide downwardly relative to said post while loosening of said screw permits said slide to move upwardly relative to said post.

7. A rotatable post assembly as defined in claim 6 further including a hole formed through said one side of said post and alined with the hole in said anchor block, said inwardly struck means comprising a flange extending inwardly from the hole in said post.

8. A rotatable post assembly as defined in claim 6 further including a hole formed through one side of said post and alined with the hole in said anchor block, said screw having a head located entirely inwardly of said one side of said post.

9. A rotatable post assembly comprising upper and lower opposing bearing members, a post extending vertically between said bearing members and having an upper end portion rotatably supported by said upper bearing member, the lower end portion of said post being tubular, a slide having upper and lower end portions and telescoped into the lower end portion of the post, a bearing element on the lower end portion of said slide and located below the lower end portion of said post to engage said lower bearing member and rotatably support the lower end portion of the post, a downwardly inclined surface formed on the upper end portion of said slide, a nut anchored within said post and formed with a threaded hole having an axis disposed substantially perpendicular to said inclined surface, coacting means on said nut and said slide to restrict rotation of said slide within said post and to captivate said slide against sliding upwardly and downwardly beyond a limited range relative to said post, a screw having a shank extending through one side of said post and threaded into said hole in said nut, the inner end of said screw slidably engaging said inclined surface whereby tightening of said screw forces said slide downwardly relative to said post while loosening of said screw permits said slide to move upwardly relative to said post.

10. A rotatable post assembly as defined in claim 9 further including means struck inwardly from said post and staking said nut against rotating and sliding within said post.

* * * * *